United States Patent [19]

Schultz, Jr.

[11] 4,180,929

[45] Jan. 1, 1980

[54] TAMPER INDICATING LABEL

[75] Inventor: Thomas E. Schultz, Jr., Lakeland, Minn.

[73] Assignee: Minnesota Mining and Manufacturing Company, St. Paul, Minn.

[21] Appl. No.: 871,361

[22] Filed: Jan. 23, 1978

[51] Int. Cl.[2] ..... G09F 3/02

[52] U.S. Cl. ..... 40/2.2; 283/18; 283/9 R

[58] Field of Search ..... 40/2.2, 2 R; 283/18, 283/21, 2 R, 2.2, 9 R

[56] References Cited

U.S. PATENT DOCUMENTS

| | | | |
|---|---|---|---|
| 3,631,617 | 1/1972 | Pekko | 40/2.2 |
| 3,755,935 | 9/1973 | Annennerg | 40/2.2 |
| 4,070,774 | 1/1978 | Staats | 40/2.2 |

*Primary Examiner*—Louis G. Mancene
*Assistant Examiner*—Wenceslao J. Contreras
*Attorney, Agent, or Firm*—Cruzan Alexander; Donald M. Sell; Richard Francis

[57] ABSTRACT

Tamper indicating label having strong protective film applied to a relatively fragile base film having adhesive on the opposite side. Sets of indicia and masking layers are printed on the label base with inks of differing adhesivity and overlain by a layer of clear polymeric material such as an ink residue having relatively low adhesivity to the label base but good adhesivity to the masking layers.

10 Claims, 3 Drawing Figures

TAMPER INDICATING LABEL

Figure 1:
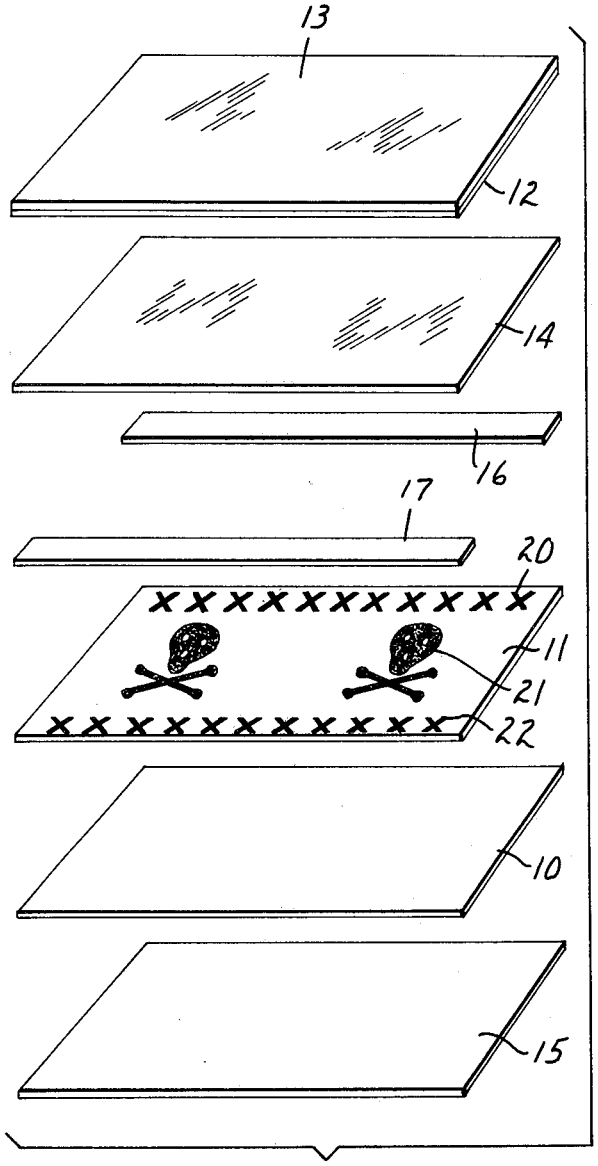

This invention relates to tamper indicating labels and particularly labels which indicate the fact of tampering while retaining a predetermined portion of the initial indicia in legible form but cannot be removed without extensive destruction.

There is an increasing need for warning and identification labels which are resistant to tampering. In some important uses for identification labels they should also resist attempts to remove the label as a whole unit to be transferred to another surface. Labels are in use which have indicia which uniquely identify the object or device to which the label is attached. Identification labels may also carry a message warning of a hazard contained within the device. It is important that such identification labels should resist removal for the purpose of transfer, and that if the label is tampered with that it should be obvious from the appearance of the label. For labels carrying a warning message, it is important that this message not be destroyed as the label is modified during tampering.

Labels are known from the patent art which can demonstrate tampering. U.S. Pat. No. 3,623,944 discloses a two layer label where the exposed layer is friable, polymeric film adhered to a substance by a pressure sensitive adhesive which has an adhesive bond which is greater than the tensile strength of the film layer. Attempts to remove the label result in rupture of the film which can be removed only in small pieces. Because the label is fragmented by an attempted removal, the indicia on the label are destroyed simultaneously.

U.S. Pat. No. 3,864,855 discloses a label construction which is similar to the above with the addition of a self-supporting protective film adhesively bonded to the friable label base. A mask is printed on a part of the exposed surface of the friable or brittle label base before the top protective film is adhesively bonded to the base film. This mask serves as a release surface for the adhesive of the protective film, and during the attempted removal the top film will separate from the label base. When the top film is separated from the label base, it will remove indicia carried on the label base which were not masked; and thereby, destroys the message of the label.

U.S. Pat. No. 3,631,617 discloses multilayer tamperproof label constructions prepared from one or more self-supporting films which have patterned masks printed on them. Indicia are printed over the surface which contains the patterned mask on both the mask and exposed surface and adhesive is then applied. Because the mask and the indicia have different adhesion to the self-supporting film, removal of this latter film causes part of the indicia to remain on the substrate with the adhesive and part to be removed with the film. Attempted removal of the label thus results in the destruction of the message of the indicia.

It will be evident that the labels of the prior art rely on the destruction of the label base and/or message to indicate the attempted removal of the label. Any cautionary or other message which should be retained by the label becomes unintelligible in the above removal processes.

It is therefor an aim and object of the present invention to provide a label in the form of a laminate which can display a portion of the indicia thereon both before and after attempts at removal and additionally can provide clear visual evidence of attempts at removal. Other aims and objects will become evident herein elsewhere.

In accordance with the above and other objects of the invention there is provided a laminate consisting essentially of (a) first and second polymeric plies, said first polymeric ply being substantially transparent and having a tensile strength at least 40% greater than said second polymeric ply, (b) first and second tacky and cohesive pressure sensitive adhesive layers, (c) first and second sets of indicia printed on said second polymeric ply, (d) masking coating over said first set of indicia and (e) polymeric coating over said masking coating, said second set of indicia and said second polymeric ply and having low adhesivity to said second polymeric ply and substantially greater adhesivity to said first pressure sensitive adhesive layer, said second set of indicia and one of said masking coating and said first set of indicia having substantially greater adhesivity to said second polymeric ply than the other of said masking coating and said first set of indicia.

In one embodiment of a label of the invention the first set of indicia have substantially greater adhesivity to the second polymeric ply than the adhesivity of the masking coating to the second polymeric ply and tampering with the label of the invention reveals the first set of indicia as a positive. In another embodiment of a label of the invention the first set of indicia have substantially less adhesivity to the second polymeric ply than the adhesivity thereto of the masking coating and tampering with the label of the invention reveals the first set of indicia as a negative.

The tamper indicating label of the invention formed from the above described laminate overcomes the aforementioned deficiencies of prior art labels by exposing indicia through the removal process. Because this tamper message is an addition to the overall message of the label rather than a destruction, the original message of the label remains intelligible. This is particularly important when that message warns of a hazard, poison, electrical, radioactive, etc. Labels of the present invention can also be used for dual purposes, such as identifying a device uniquely and warning of a potential hazard. Attempted removal of the label might destroy the identification, such as a serial number, but leave the warning message intact.

The label construction of the invention will now become more apparent from the drawings herewith wherein FIG. 1 shows an exploded diagram of a tamper indicating label according to the invention.

Figure 2:
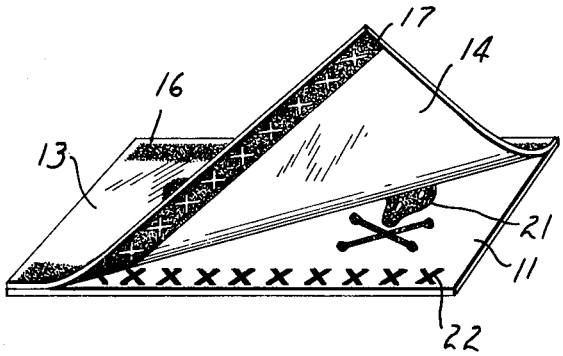
Figure 3:
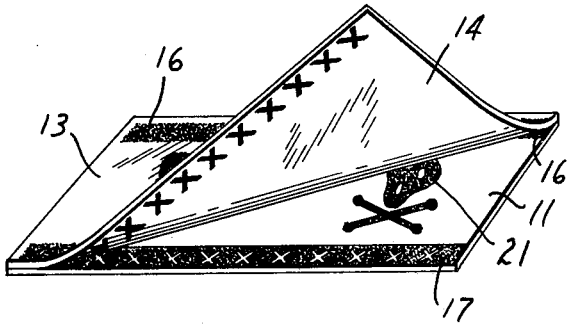

FIGS. 2 and 3 show variations of the label after attempted removal of part of the label. The same reference numbers are used in all figures.

Referring to the figures, it will be evident that the tamper indicating label of the invention is a multilayer laminate having base (11) which is a fragile, polymeric film and which has pressure sensitive adhesive (10) bonded to one surface. When sold a release liner (15) is provided on the adhesive opposite the label base. This release liner can be a polysiloxane coated paper or plastic or other sheet material which releases readily from adhesive (10) serves to protect the pressure sensitive adhesive from dirt and is removed and discarded to expose the adhesive for bonding the label to the desired substrate. On the surface of label base (11) and opposite adhesive (10) are printed indicia (20), (21) and (22) and masking layers (16) and (17). A further polymeric layer

(14) is applied over the entire label base and indicia thereon.

In these figures the first polymeric ply is (13), the second fragile polymeric ply is (11), the first adhesive layer is (12), the second adhesive layer is (10) and the polymeric coating is (14). It will be seen that first adhesive layer (12) has one adhesive surface adhered to first polymeric ply (13) and the opposite adhesive surface adhered to polymeric coating (14) and that one adhesive surface of second adhesive layer is adhered to second polymeric ply (11) and the opposing adhesive surface protected by release liner (15). In use, of course, release liner (15) is removed and adhesion is effected to the desired substrate as will be well understood by those of skill in the art.

Indicia (21) are shown as the skull and crossbones signifying a poison but there may be an emblem designating other hazard or a word such as "caution." Indicia (20) and (22) are shown as sequences of crosses but other indicia may be employed such as the word "void" or a statement such as "warranty voided." The indicia may also be in various languages.

The masking layers (16) and (17) are printed directly over indicia (20) and (22) respectively and extend outward therefrom to cover portions of base (11).

Adhesively bonded to the surface of label base (11) and the indicia and masking layers thereon is a protective composite which is comprised of a pressure sensitive adhesive layer (12) and a clear film layer (13). This composite serves to protect the indicia on the label base, adds strength to the total label and cooperates in indicating tampering with the label.

The characteristic tamper-indicating feature of labels and laminates of the invention results from cooperation of the several laminae and the variable adhesion properties predetermined for the various inks. Indicia (21) are printed with an ink having good adhesivity to label base (11). Polymeric layer (14) is a transparent or slightly tinted ink which has low adhesivity to the unprinted areas of base film (11). Low adhesivity means that the ink adheres well enough to remain attached during normal handling and abrasion but is substantially less than the good adhesivity of the ink of indicia (21) to base (11). As a result the polymeric film (14) separates selectivity from base (11) when protective film (13) and adhesive layer (12) are removed.

Masking layers (16) and (17) are printed with an opaque ink and hide the tamper indicating indicia (20) and (22). They can effect this function in either of two ways. If the ink of masking layers (16) and (17) are of an ink that adheres well to base (11) and to the indicia (20) and (22) such as the ink used for indicia (21), then the tamper indicating indicia (20) and (22) are of an ink with low adhesivity to base (11) and as polymeric layers (14) and the protective film composite of layers (12) and (13) are removed, the masking layers (16) and (17) are removed only where underlying by indicia (20) and (22) and the indicia of (20) and (22) appear as negatives, i.e., as in FIG. 3.

Alternatively masking layers (16) and (17) are printed with an ink having low adhesivity to base (11) but good adhesivity to indicia (20) and (22). Indicia (20) and (22) are printed with an ink having good adhesivity as used for indicia (21). When layers (12), (13) and (14) are removed as described above the indicia (20) and (22) are exposed as positives, i.e., as in FIG. 2.

During an attempted removal of tamper indicating labels according to the invention, the protective transparent film (13) and adhesive (12) separates from the label base because the adhesion of the protective film is greater to the overall polymeric layer (14) than the adhesion of polymeric layer (14) is to base film (11). After the attempted removal, indicia (20) and (22), suitably a tamper indicating message, appear on the face of the label. Label base (11) is preferably of lower tensile strength than the cohesive and adhesive strength of adhesive (10) to the substrate on which the label is placed which means that the label cannot be removed intact. When protective film (13) is removed it no longer has an available tacky surface of adhesive (12) because polymeric layer (14) covers the adhesive. It is very difficult or impossible to restore the label to its original condition or to reapply it. Furthermore, removed masking layers are not tacky and do not adhere to the label base.

Label base (11) may be pigmented to be opaque or it may be transparent and it should provide a suitable surface to allow adhesion of the inks. Preferably, the tensile strength of label base (11) is less than the adhesive and cohesive strengths of pressure sensitive adhesive (10) in order to resist any removal attempts. A suitable fragile label base is prepared from a pigmented, thin film of polyvinylchloride which is low in plasticizer. Thin fragile films can also be prepared from acrylate esters, methacrylate esters, cellulose esters, polystryene, and the like and are suitable as label bases. Many such films are known to the art.

Pressure sensitive adhesive (10) must provide good adhesion to the label base and to the substrate to which the label is to be applied. The selection of adhesive (10) depends in part on the substrate. One suitable pressure sensitive adhesive is the acrylate ester type as disclosed in Ulrich, U.S. Pat. No. Re. 24,906.

The top protective film composite consists of a self-supporting transparent film (13) and a pressure sensitive adhesive (12). Adhesive (12) may be the same as adhesive (10) or may be different. It should provide a good bond between protective film (13) and the overall clear polymeric layer (14) and should be transparent to permit seeing indicia (21) on the label base. Film (13) has the greatest tensile strength of any portion of the laminate. Useful materials include particularly polyester films and also cellulose esters, polymers and copolymers of vinyl chloride, polyethylene, polypropylene, and the like.

As noted in the discussion of the figures the various indicia, masking layers and polymeric layer are applied by printing using inks having predetermined degrees or relative adhesivities to one another and/or to label base (11). Indicia (20), (21) and (22) are normally printed from pigmented inks although in the case where indicia (20) and (22) have low adhesivity to label base (11) they can be printed using a very lightly pigmented or substantially nonpigmented ink such as is also used for polymeric layer (14). Compounding of inks having desired properties of adhesion is within the skill of the art and, in fact, commercially available inks can be selected having the desired combinations of properties.

The invention is now further illustrated by an example.

EXAMPLE 1

A label base having suitable fragility, i.e., low tensile strength, is prepared by blending the following components A and B and coating the blend to the desired thickness on a casting liner.

Component A is a polyvinylchloride (PVC) organosol dispersion prepared by pebble milling the following materials, all parts by weight:

| | |
|---|---|
| 17.4 parts | xylene (mixed isomers) |
| 11.0 parts | diisobutylketone |
| 3.5 parts | hydrocarbon solvent (distillate fraction of about 96% aromatic and 4% aliphatic compounds with an initial boiling point of 149° C.) |
| 11.6 parts | polyester plasticizer for PVC having an acid value of 2 to 3.5 and a Brookfield viscosity (N0. 3 spindle at 12 rpm at 25° C.) of 3800 to 4700 cps. |
| 1.8 parts | barium-cadmium-zinc organic stabilizer for PVC |
| 34.3 parts | polyvinylchloride dispersion grade resin (inherent viscosity 1.12 to 1.20 (by ASTM-D-1243-60 Method A) |
| 20.4 parts | chalk resistant rutile titanium dioxide pigment with an average particle size of 0.2 micron. |

Component B is a 50 weight percent solids solution of polyethylmethacrylate (available as Elvacite 2013 from duPont E. I. de Nemours & Co.), dissolved in a blend of the above three solvents in the above ratio.

Components A and B are blended at a weight percent ratio of 90.5% component A and 9.5% component B, and the blend is mixed until uniform. It will be understood that the selection of solvents and exact proportions can be varied as is known in the art. The blend which is a viscous liquid is coated to a thickness of about 38 microns by knife coating or by other suitable technique on a casting liner for PVC resin dispersions, (commercially available from S. D. Warren Co.). The coating is dried on the liner to remove most of the solvents and then heated and fused at 200° C. to an integral film about 25 microns thick. The film (removed from the casting liner) has a tensile strength of about 1.5 kg with 5 to 15% elongation at break when 2.54 cm wide sample is tested in an Instron tensile tester using 10 cm jaw separation and about 30 cm/min jaw separation rate. Increasing the amount of plasticizer or using a more efficient plasticizer, e.g., diisooctyl phthalate, increases the elongation. Increasing the amount of pigment or the amount of polyethylmethacrylate decreases the elongation. Changing the type of pigment or adding an extender pigment, such as finely divided calcium carbonate or barium sulfate, also changes the elongation properties. The tensile strength can be adjusted within limits by changing the thickness of the film.

Similar film elongation properties can be achieved with other resins than polyethylmethacrylate or, without any additional resin, the elongation can be controlled by varying the amount and type of plasticizer.

On a separate polysiloxane coated release liner is coated a tackified polyacrylate pressure sensitive adhesive containing acrylic acid monomer as described in Ulrich, U.S. Pat. No. Re. 24,906 to a dry thickness of about 12 microns. This particular adhesive at this thickness provides an aged bond to aluminum of about 1.8 kg for 180° pull back as tested on an Instron tensile testing machine at a jaw separation rate of about 30 cm/min. The combination of adhesive with this bond strength and label base with low elongation provides a label base which is very difficult to remove in one piece when once adhered to a substrate. Other adhesives can be used providing that the bond strength is sufficiently high to resist removal of the label base. Though pressure sensitive adhesives provide convenience in application, adhesives which are heat or solvent activated can also be used and are considered the equivalent.

The coated adhesive is laminated to the exposed surface of the label base film and the casting liner used as the carrier for the label base is removed providing a laminate of the label base, the adhesive and the polysiloxane release liner. This laminate is then used in the flexographic printing operations described below. Other methods of printing are also useful. In this description, the label as represented by FIG. 2 is prepared in which indicia (20) and (22) appear as positives when the protective layer is removed. Reversing the inks involved as described above produces the label shown in FIG. 3. Inks having good adhesivity to the label base may have, for example, vinyl acrylic bases whereas inks with relatively low adhesivity may have nitrocellulose bases.

For purposes of this example commercial inks are used available from Inmont Corporation, New York, N.Y. The ink with good adhesivity to the label base is available under the tradename Pliolox (in several colors and colorless) and the ink with low adhesivity to the label base is available under the tradenames Flexolume. The skull and crossbones indicia (21) are printed one in black and one in red using Pliolox inks and indicia (20) and (22) are printed using a slightly pigmented Pliolox ink. Masking layers (16) and (17) are then printed using black Flexolume ink and clear polymeric layer (14) is printed over all with a transparent Flexolume ink. A transparent protective tape composed of adhesive (12) and clear plastic (13) (available commercially, for example, as "SCOTCH" Brand No. 853 tape from 3M Company, St. Paul, MN) having tensile strength of at least 2.1 kg, i.e. 40% greater than that of the label base film, is then applied to the surface of the above printed laminate. Labels are cut as desired. For application to a substrate, the release liner (15) is removed and the label is applied. The label is found to separate as described for FIG. 2 when attempts are made to remove it. Reversing the ink usage provides labels which separate as shown in FIG. 3.

What is claimed is:

1. A laminate especially suited as a tamper indicating label consisting essentially of (a) first and second polymeric plies, said first polymeric ply being substantially transparent and having a tensile strength at least 40% greater than said second polymeric ply, (b) first and second tacky and cohesive pressure sensitive adhesive layers, (c) first and second sets of indicia printed on said second polymeric ply, (d) masking coating over said first set of indicia but not over said second set of indicia and (e) a transparent or tinted polymeric coating over said masking coating, said second set of indicia and said second polymeric ply, said polymeric coating having low adhesivity to said first pressure sensitive adhesive layer, said second set of indicia and one of said masking coating and said first set of indicia having substantially greater adhesivity to said second polymeric ply than the other of said masking coating and said first set of indicia whereby before tampering said second set of indicia is fully visible and said first set of indicia is not visible when said laminate is adhesively attached to a substrate by said second pressure sensitive adhesive layer and tampering reveals said second polymeric ply bearing fully visible both said first set of indicia and said second set of indicia.

2. A laminate according to claim 1 wherein the first set of indicia have substantially greater adhesivity to the second polymeric ply than the adhesivity of the masking coating thereto.

3. A laminate according to claim 1 wherein the first set of indicia have sustantially less adhesivity to the second polymeric ply than the adhesivity of the masking coating thereto.

4. A laminate according to claim 1 wherein the second polymeric ply has a thickness of 12 microns to 50 microns.

5. A laminate according to claim 1 wherein the first polymeric ply has a thickness of 12 microns to 50 microns.

6. A laminate according to claim 1 wherein a removable polysiloxane coated paper or plastic as release liner is adhered to the second pressure sensitive adhesive opposite the second polymeric ply.

7. A laminate according to claim 1 wherein the masking coating covering the first set of indicia covers a surface area less than 50% of the total surface area of the second polymeric ply.

8. A laminate according to claim 1 wherein the first and second pressure sensitive adhesives are polymerized primarily from acrylate esters.

9. A laminate according to claim 1 wherein the first polymeric ply is of oriented polyethylene terephthalate.

10. A laminate according to claim 1 wherein the second polymeric ply is of at least 75% plasticized polyvinylchloride organosol dispersion.

* * * * *